US008833980B2

(12) United States Patent
Pickard et al.

(10) Patent No.: US 8,833,980 B2
(45) Date of Patent: Sep. 16, 2014

(54) HIGH EFFICIENCY LED LAMP

(75) Inventors: Paul Kenneth Pickard, Morrisville, NC (US); Gerald H. Negley, Chapel Hill, NC (US); Mark Edmond, Raleigh, NC (US)

(73) Assignee: Cree, Inc., Durham, NC (US)

( * ) Notice: Subject to any disclaimer, the term of this patent is extended or adjusted under 35 U.S.C. 154(b) by 262 days.

(21) Appl. No.: 13/103,303

(22) Filed: May 9, 2011

(65) Prior Publication Data

US 2012/0287619 A1 Nov. 15, 2012

(51) Int. Cl.
*F21V 29/00* (2006.01)
*F21K 99/00* (2010.01)

(52) U.S. Cl.
CPC ..... *F21K 9/135* (2013.01); *F21V 29/004* (2013.01)
USPC ..... 362/311.02; 362/321; 362/555

(58) Field of Classification Search
USPC ..... 362/249.02, 311.02, 231, 555
See application file for complete search history.

(56) References Cited

U.S. PATENT DOCUMENTS

| | | | | |
|---|---|---|---|---|
| 7,213,940 | B1 | 5/2007 | Van De Ven et al. | |
| 7,513,666 | B2 * | 4/2009 | Ishikura et al. | 362/555 |
| 8,070,328 | B1 * | 12/2011 | Knoble et al. | 362/311.02 |
| 2003/0012018 | A1 | 1/2003 | Kluth | |
| 2004/0070014 | A1 | 4/2004 | Lin et al. | |
| 2005/0135079 | A1 | 6/2005 | Yin Chua et al. | |
| 2009/0052189 | A1 * | 2/2009 | Kon | 362/296.01 |
| 2009/0323315 | A1 * | 12/2009 | Tuite et al. | 362/98 |
| 2010/0124243 | A1 * | 5/2010 | Hussell et al. | 372/45.01 |
| 2010/0149815 | A1 * | 6/2010 | Erchak | 362/293 |
| 2010/0254129 | A1 | 10/2010 | Le Toquin et al. | |
| 2011/0026264 | A1 | 2/2011 | Reed et al. | |
| 2011/0075411 | A1 * | 3/2011 | Van De Ven et al. | 362/235 |
| 2011/0170289 | A1 | 7/2011 | Allen et al. | |

FOREIGN PATENT DOCUMENTS

WO 2006016324 A1 2/2006

OTHER PUBLICATIONS

American National Standard, ANSI C78.20-2003 for electric lamps, A, G, PS, and Similar Shapes with E26 Screw Bases, Oct. 30, 2003, 48 pages.
U.S. Department of Energy, Bright Tomorrow Lighting Competition (L Prize™), Jun. 26, 2009, Revision 1, 18 pages.
CREE, Inc., International Application No. PCT/US2012/036731, International Search Report and Written Opinion, Oct. 25, 2012.
CREE, Inc.,U.S. Appl. No. 13/190,661, Office Action dated Apr. 1, 2013.

* cited by examiner

*Primary Examiner* — Laura Tso
(74) *Attorney, Agent, or Firm* — Steven B. Phillips; Moore & Van Allen PLLC

(57) ABSTRACT

A high-efficiency LED lamp is disclosed. Embodiments of the present invention provide a high-efficiency, high output solid-state lamp. The lamp includes an LED assembly, and an optical element or diffuser disposed to receive light from the LED assembly. The optical element includes a primary exit surface for the light, wherein the primary exit surface is at least about 1.5 inches from the LED assembly. In example embodiments, the optical element is roughly cylindrical in shape. An LED lamp according to some embodiments of the invention has an efficiency of at least 150 lumens per watt. In some embodiments, the lamp has a light output of at least 1200 lumens. In some embodiments, the LED lamp produces light with a color rendering index (CRI) of at least 90 and a correlated color temperature of from 2800 to 3000 K.

27 Claims, 3 Drawing Sheets

HIGH EFFICIENCY LED LAMP

BACKGROUND

Light emitting diode (LED) lighting systems are becoming more prevalent as replacements for existing lighting systems. LEDs are an example of solid state lighting (SSL) and have advantages over traditional lighting solutions such as incandescent and fluorescent lighting because they use less energy, are more durable, operate longer, can be combined in red-blue-green arrays that can be controlled to deliver virtually any color light, and contain no lead or mercury.

In many applications, one or more LED dies (or chips) are mounted within an LED package or an LED module, which may make up part of a lighting fixture which includes one or more power supplies to power the LEDs. Some lighting fixtures include multiple LED modules. A module or strip of a fixture includes a packaging material with metal leads (to the LED dies from outside circuits), a protective housing for the LED dies, a heat sink, or a combination of leads, housing and heat sink. An LED fixture may be made with a form factor that allows it to replace a standard threaded incandescent bulb, or any of various types of fluorescent or halogen lamps. LED fixtures and lamps often include some type of optical elements external to the LED modules themselves. Such optical elements may allow for localized mixing of colors, collimate light, and/or provide a controlled beam angle.

Color reproduction can be an important characteristic of any type of artificial lighting, including LED lighting. For lamps, color reproduction is typically measured using the color rendering index (CRI). The CRI is a relative measurement of how the color rendition of an illumination system compares to that of a particular known source of light. In more practical terms, the CRI is a relative measure of the shift in surface color of an object when lit by a particular lamp. The CRI equals 100 if the color coordinates of a set of test surfaces being illuminated by the lamp are the same as the coordinates of the same test surfaces being irradiated by the known source. CRI is a standard for a given type light or light from a specified type of source with a given color temperature. A higher CRI is desirable for any type of replacement lamp.

In some locales, government, non-profit and/or educational entities have established standards for SSL products, and provided incentives such as financial investment, grants, loans, and/or contests in order to encourage development and deployment of SSL products meeting such standards to replace common lighting products currently used. For example, in the United States, the Bright Tomorrow Lighting Competition (L Prize™) has been authorized by the Energy Independence and Security Act of 2007 (EISA). One version of the specification for the L Prize is described in *Bright Tomorrow Lighting Competition* (*L Prize*™), Jun. 26, 2009, Document No. 08NT006643, the disclosure of which is hereby incorporated herein by reference. The L Prize is awarded for various categories of lighting products. One recently authorized category of lamp authorized for L Prize consideration is a very high efficiency, bright lamp, for which no particular form factor is required.

SUMMARY

Embodiments of the present invention provide a high-efficiency, high output solid-state lamp. The lamp can include an LED assembly and an optical element disposed to receive light from the LED assembly. The optical element includes a primary exit surface for the light, wherein at least a portion of the primary exit surface is at least about 1.5 inches from the LED assembly. In example, embodiments, the optical element is roughly cylindrical, cylindrical, or frustoconical in shape, so that a large percentage of light from the LED assembly strikes curved walls of the optical element at an oblique angle and exits the fixture through the primary exit surface of the optical element.

An LED lamp according to some embodiments of the invention has a light output of at least 1200 lumens. In some embodiments, the lamp has an efficiency of at least 150 lumens per watt. In some embodiments, the LED lamp produces light with a color rendering index (CRI) of at least 90. In some embodiments, the lamp produces warm white light. In some embodiments, the lamp produces light with a correlated color temperature of from 2500 to 3500 K. In some embodiments, the lamp produces light with a correlated color temperature of from 2800 to 3000 K.

In some embodiments, the primary exit surface for the optical element of the lamp is about 3 inches from the LED assembly of the lamp. In some embodiments, the primary exit surface or a portion of the primary exit surface is spaced from about 1.5 to about 8 inches away from the LED assembly. In some embodiments, the primary exit surface or a portion of the primary exit surface is spaced from about 3 to about 8 inches from the LED assembly. In at least some embodiments of the invention, the lamp includes a power supply portion including a power supply electrically connected to the LED assembly. In some embodiments, the power supply portion of the lamp includes an Edison base. The lamp can be assembled by providing the LED assembly, connecting the LED assembly to the power supply and installing the optical element so as to receive light from the LED assembly.

In some embodiments of the lamp, the LED assembly is constructed to include at least two LEDs or groups of LEDs, wherein one LED or group, when illuminated, emits light having a dominant wavelength from 435 to 490 nm, and another LED or group, when illuminated, emits light having a dominant wavelength from 600 to 640 nm. One LED or group of LEDs is packaged with a phosphor, which, when excited, emits light having a dominant wavelength from 540 to 585 nm. In some embodiments, the first and second LEDs or groups of LEDs emit light having a dominant wavelength from 440 to 480 nm, and a dominant wavelength from 605 to 630 nm, respectively and the phosphor, when excited, emits light having a dominant wavelength from 560 to 580 nm.

BRIEF DESCRIPTION OF THE DRAWINGS

FIG. 2 shows the power supply portion and the LED assembly of a lamp.

DETAILED DESCRIPTION

Figure 1:
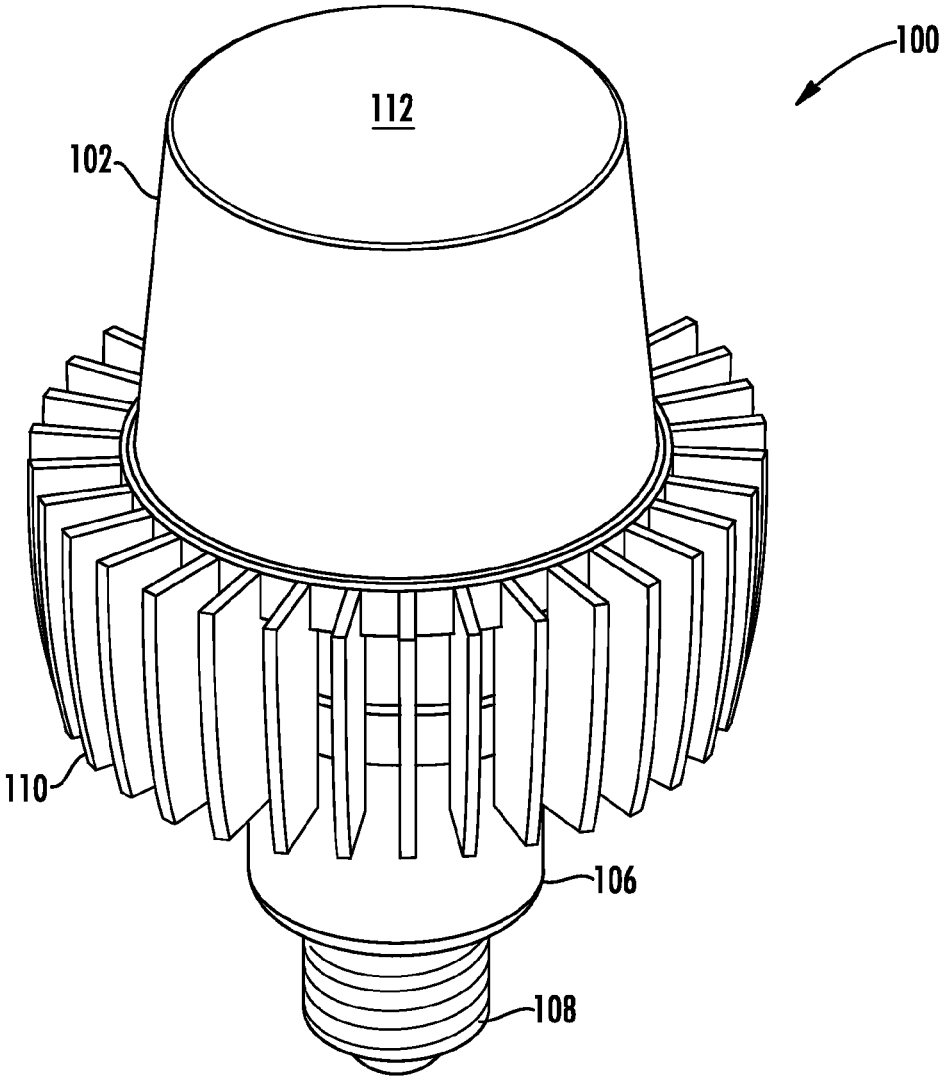
FIG. 1 is a perspective view of an LED lamp according to example embodiments of the present invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

Unless otherwise expressly stated, comparative, quantitative terms such as "less" and "greater", are intended to encompass the concept of equality. As an example, "less" can mean not only "less" in the strictest mathematical sense, but also, "less than or equal to."

Figure 2:
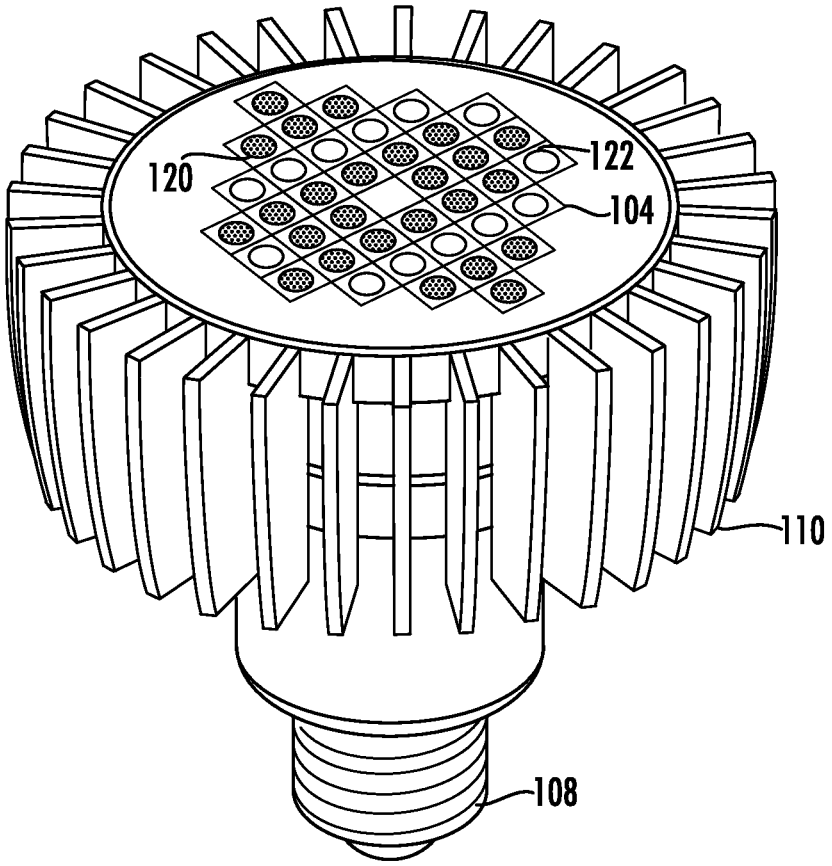
FIG. 2 is a perspective view of a partially assembled LED lamp according to example embodiments of the invention. More specifically.
Figure 3:
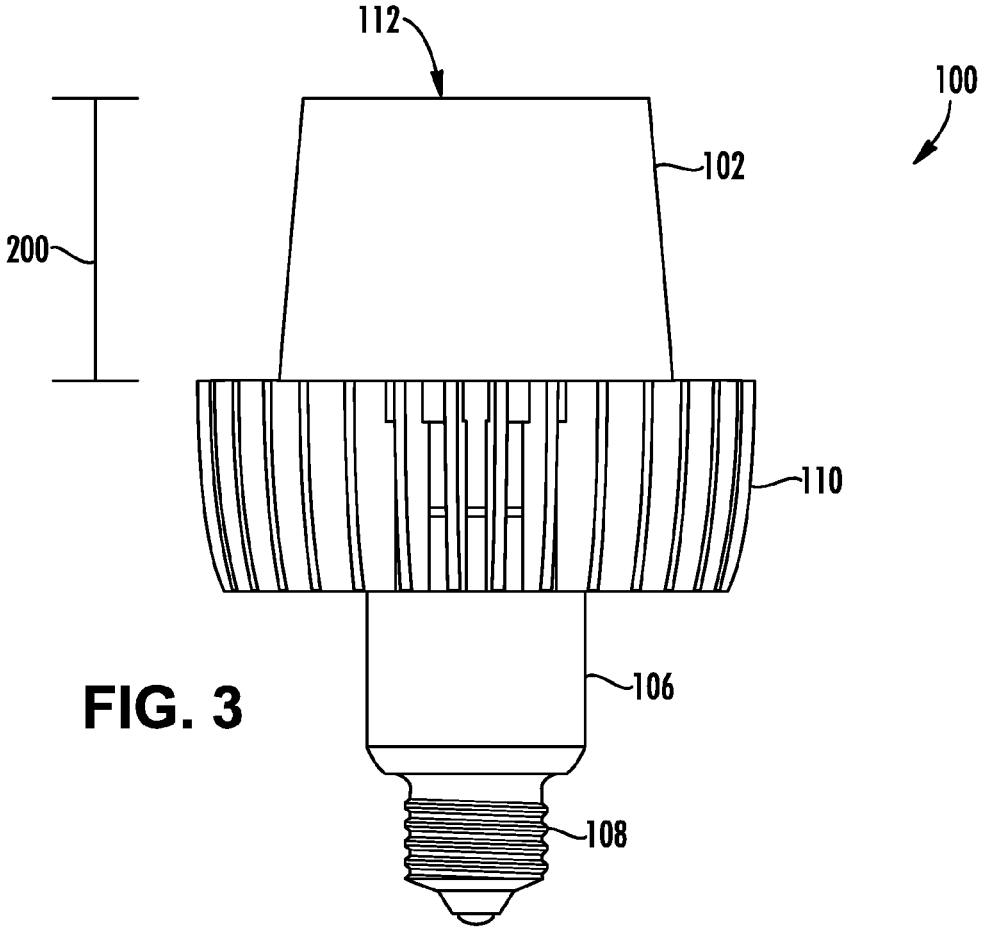
FIG. 3 is a side view of an LED lamp according to example embodiments of the present invention.
Figure 4:
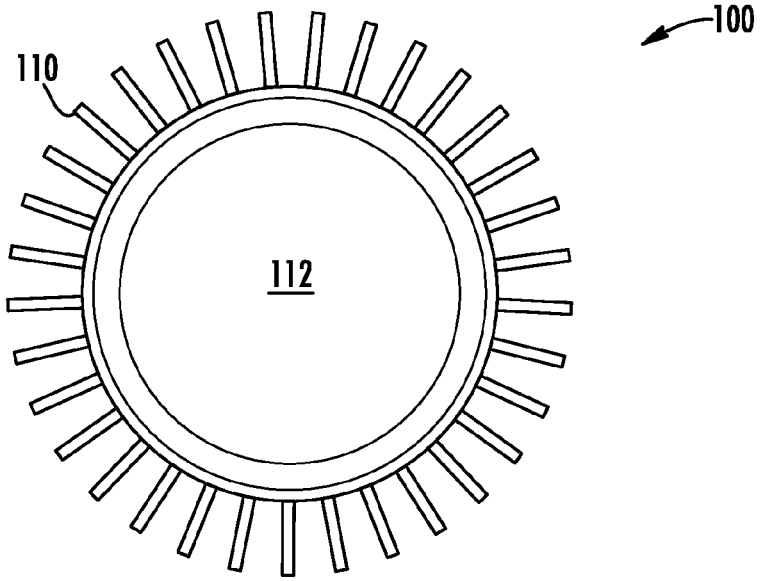
FIG. 4 is a top view of an LED lamp according to example embodiments of the present invention.

FIG. 1 shows a perspective view of an LED lamp according to example embodiments of the invention, and FIG. 2 shows a similar perspective view with the optical element removed, leaving the power supply portion and the LED assembly. FIG. 3 is a side view of the lamp of FIG. 1 and FIG. 4 is a top view of the lamp. Lamp 100 includes an optical element 102 and an LED assembly 104. LED assembly 104 of the lamp has been interconnected with a power supply in power supply portion 106 of the lamp. The power supply portion 106 of the lamp includes the power supply consisting of circuitry (not visible) to provide DC current to an LED assembly. To assemble the power supply portion of the lamp, the circuitry may be installed within the void in the power supply portion and potted, or covered with a resin to provide mechanical and thermal stability. The potting material fills the space within power supply portion 106 not occupied by power supply components and connecting wires.

The particular power supply portion of an LED lamp shown includes Edison base 108 and a heat sink 110. The Edison base can engage with an Edison socket so that this example LED lamp can be used in some fixtures designed for incandescent lamps. The electrical terminals of the Edison base are connected to the power supply to provide AC power to the power supply. The particular physical appearance of the power supply portion and type of base included are examples only. Numerous types of LED lamps can be created using embodiments of the invention, with various types of bases and shapes. Bulbs with Edison style bases are described in American National Standard ANSI C78.20-2003 for electric lamps, A, G, PS, and *Similar Shapes with E26 Screw Bases*, Oct. 30, 2003, which is incorporated herein by reference.

LED assembly 104 of lamp 100 further includes multiple LED modules mounted on a carrier such as a circuit board, which provides both mechanical support and electrical connections for the LEDs. LED assembly 104 in this example embodiment includes twenty-five LED packages or LED modules, in which an LED chip is encapsulated inside a package with a lens and leads. The LED modules include LEDs operable to emit light of two different colors. In this example embodiment, the LED modules 120 in LED assembly 104 in lamp 100, when illuminated, emit light having dominant wavelength from 440 to 480 nm. The LED modules 122 in LED assembly 104 in lamp 100, when illuminated, emit light having a dominant wavelength from 605 to 630 nm. In some embodiments some LEDs are packaged with a phosphor. A phosphor is a substance, which, when energized by impinging energy, emits light. In some cases, phosphor is designed to emit light of one wavelength when energized by being struck by light of a different wavelength, and so provides wavelength conversion. In the present example embodiment, one group of LEDs in LED assembly 104 is packaged with a phosphor which, when excited by light from the included LED, emits light having a dominant wavelength from 560 to 580 nm. In some embodiments of the invention, one LED or group, when illuminated, emits light having a dominant wavelength from 435 to 490 nm, and the other LED or group, when illuminated, emits light having a dominant wavelength from 600 to 640 nm. In some embodiments the phosphor, when excited, emits light having a dominant wavelength from 540 to 585 nm.

In the present embodiment, the phosphor is included in modules 120 of lamp 100. In this example, the phosphor is deposited on the encapsulating lens for each LED at such a thickness so that some of the light from the LED goes through the phosphor, while other light is absorbed and the wavelength is converted by the phosphor. Thus, each LED is packaged in a module 120 to form a blue-shifted yellow (BSY) LED device, while the light from each LED in modules 122 passes out of the LED module as red or orange (red/orange) light. Thus, substantially white light can be produced when these two colors from the modules in the LED assembly are combined. Thus, this type of LED assembly may be referred to as a BSY+R LED assembly. In the particular example shown in FIG. 2, there are 25 BSY and 13 red LED packages. The numbers of LEDs used in the LED assembly, both in total and the relative numbers of different types of LEDs, can be varied in accordance with the required size and output of the lamp and the color light desired.

In addition to a high color rendering index (CRI), light can be produced using an LED assembly like that above wherein the light in some embodiments has a white warm correlated color temperature (CCT). White warm light is light having a CCT of less than about 4000K. In some embodiments, the light from the LED lamp has a CCT from 2500K to 3500K. In other embodiments, the light can have a CCT from 2700K to 3300K. In still other embodiments, the light can have a CCT from about 2725K to about 3045K. In some embodiments, the light can have a CCT of between about 2800K and 3000K. In still other embodiments, where the light is dimmable, the CCT may be reduced with dimming. In such a case, the CCT may be reduced to as low as 1500K or even 1200K.

It should be noted that other arrangements and numbers of LEDs can be used with embodiments of the present invention. The same number of each type of LED can be used, and the LED packages can be arranged in varying patterns. A single LED of each type could be used. Additional LEDs, which produce additional colors of light, can be used. Phosphors can be used with all the LED modules. A single phosphor can be used with multiple LED chips and multiple LED chips can be included in one, some or all LED device packages. A further detailed example of using groups of LEDs emitting light of different wavelengths to produce substantially white light can be found in issued U.S. Pat. No. 7,213,940, which is incorporated herein by reference.

Optical element 102 of lamp 100 includes a primary exit surface 112 for light emitted from LED assembly 104. Such an optical element may also be referred to as a "dome" (notwithstanding its shape), an enclosure, or an optical enclosure. In some embodiments, optical element 102 may provide color mixing so that color hot spots do not appear in the light pattern being emitted from the lamp. Such an optical element may also provide for diffusion of light and therefore may also be referred to as a "diffuser". Such a color mixing optical element or diffuser may be frosted, painted, etched, roughened, may have a molded-in pattern, or may be treated in many other ways to provide color mixing for the lamp. The enclosure may be made of glass, plastic, or some other material that passes light.

Still referring specifically to optical element 102 of lamp 100 shown in the Figures, the optical element is cylindrical in shape. Note that by the term, "cylindrical" what is meant is simply that it has a curved surface with an end that that is at least roughly parallel to the LED mounting surface. In this example embodiment, the end serves at the primary exit surface for light from the LED assembly. The term "cylindrical" as used herein does not mean that the shape is defined precisely by the mathematical equation for a cylinder, as clearly the example optical element shown in the Figures is not. The shape of the cylindrical optical element shown for lamp 100 is a frustoconical shape, or a truncated cone, however, a perfect cylinder and any other suitable shape can be used. The surface 110 of optical element 102 serves as the primary exit surface because a large percentage of light from the LED assembly strikes curved walls of the optical element at an oblique angle and exits the fixture through the primary exit surface of the optical element.

Optical element 102 of lamp 100 improves the efficiency of lamp 100 by spacing primary exit surface 112 away from the source of the light. This distance, 200, is indicated in the side view of lamp 100 shown in FIG. 3. The distance required for maximum efficiency and/or light output varies depending on the area taken up by the LEDs, which is in part a function of the number of LEDs used in the lamp. In one example embodiment, the primary exit surface is spaced about three inches away from the LEDs. In some embodiments, high efficiency can be achieved with as little as 1.5 inches of spacing between the LEDs and the primary exit surface. The primary exit surface can be spaced further away without significant negative impact on the efficiency or light output. In some embodiments there may be desire to limit distance 200 for aesthetic or other reasons. An optical element used with example embodiments of the invention may for example have a primary exit surface spaced away from the LED assembly a distance of from 1.5 to eight inches, or from three to eight inches.

In example embodiments, optical element 102 serves as a diffuser and is substantially cylindrical, and less than 3 inches wide. In at least one embodiment it is about 2.75 inches wide. In some embodiments it is less than or equal to 2.5 inches wide. The diffuser can be a perfect or near perfect cylinder, or can be wider at one end, such as the bottom, as in the embodiments shown in the Figures. For example, optical element could have 3, 5 or 10 degrees of draft.

Embodiments of the invention can use varied fastening methods and mechanisms for interconnecting the parts of the lamp. For example, in some embodiments locking tabs and holes can be used. In some embodiments, combinations of fasteners such as tabs, latches or other suitable fastening arrangements and combinations of fasteners can be used which would not require adhesives or screws. In other embodiments, adhesives, screws, or other fasteners may be used to fasten together the various components. The optical element described with respect to the example embodiments disclosed herein can be fastened in place with thermal epoxy. Other fastening methods can be used to fasten an optical enclosure to the other parts of the lamp. As examples, enclosures can be threaded and can screw into or onto the rest of the lamp. A tab and slot or similar mechanical arrangement could be used, as could fasteners such as screws or clips.

Features of the various embodiments of the LED lamp described herein can be adjusted and combined to produce an LED lamp that has various characteristics, including, in some embodiments, a lamp that meets or exceeds one or more of the product requirements for an L prize category. For example, the lamp may have a CRI of about 80 or more, 85 or more, 90 or more, or 95 or more. The lamp may have a luminous efficacy of at least 150 lumens per watt or at least 165 lumens per watt.

As previously mentioned, the L Prize specification defines various characteristics a solid-state lamp must have to qualify for consideration in various prize categories. One recently added category is referred to as the "Twenty-First Century Lamp" prize, intended to recognize a solid state lamp with high efficiency and high light output. Embodiments of the present invention can meet these requirements with an efficiency of at least 150 lumens per watt and a total light output of at least 1200 lumens. In some embodiments the lamp has a total light output of at least 1350 lumens per watt. Other requirements for the Twenty-First Century Lamp prize include a color rendering index of at least 90, a coordinated color temperature, also referred to as a color coordinate temperature, between 2800 K and 3000 K, and a lifetime exceeding 25,000 hours. Embodiments of the present invention can meet any or all of these specifications.

Although specific embodiments have been illustrated and described herein, those of ordinary skill in the art appreciate that any arrangement which is calculated to achieve the same purpose may be substituted for the specific embodiments shown and that the invention has other applications in other environments. This application is intended to cover any adaptations or variations of the present invention. The following claims are in no way intended to limit the scope of the invention to the specific embodiments described herein.

The invention claimed is:

1. An LED lamp comprising:

an LED assembly including at least first and second LEDs operable to emit light of at least two different colors; and an optical enclosure disposed to receive light from the LED assembly, the optical enclosure including a curved surface and a primary exit surface so that a large percentage of the light strikes the curved surface at an oblique angle and exits through the primary exit surface, at least a portion of the primary exit surface spaced at least about 1.5 inches from the LED assembly to produce light with an efficiency of at least about 150 lumens per watt.

2. The LED lamp of claim 1 having a light output of at least 1200 lumens.

3. The LED lamp of claim 2 wherein the light has a warm white color.

4. The LED lamp of claim 3 wherein the light a correlated color temperature of from 2500 to 3500 K.

5. The LED lamp of claim 4 wherein the light a correlated color temperature of from 2800 to 3000 K.

6. The LED lamp of claim 5 wherein the light has a color rendering index of at least 90.

7. The LED lamp of claim 2 wherein the first and second LEDs, when illuminated, emit light having a dominant wavelength from 435 to 490 nm and a dominant wavelength from 600 to 640 nm, respectively, and at least one of the first and second LEDs is packaged with a phosphor, which, when excited, emits light having a dominant wavelength from 540 to 585 nm.

8. The LED lamp of claim 7 wherein the first and second LEDs, when illuminated, emit light having a dominant wavelength from 440 to 480 nm, and a dominant wavelength from 605 to 630 nm, respectively and the phosphor, when excited, emits light having a dominant wavelength from 560 to 580 nm.

9. The LED lamp of claim 1 wherein the portion of the primary exit surface is spaced at least about 3 inches from the LED assembly.

10. The LED lamp of claim 1 wherein the portion of the primary exit surface is spaced from about 1.5 to about 8 inches away from the LED assembly.

11. The LED lamp of claim 10 further comprising a power supply portion including a power supply electrically connected to the LED assembly and an Edison base.

12. The LED lamp of claim 9 wherein the portion of the primary exit surface is spaced from about 3 to about 8 inches from the LED assembly.

13. A method of assembling a high-efficiency LED lamp, the method comprising:

providing an LED assembly including at least first and second LEDs operable to emit light of at least two different colors;

connecting the LED assembly to a power supply; and installing a cylindrical optical enclosure including a curved surface and a primary exit surface that provide diffusion, the optical enclosure disposed to receive light from the LED assembly so that a large percentage of the light strikes the curved surface at an oblique angle and exits through the primary exit surface, and the primary exit surface is spaced at least about 1.5 inches from the LED assembly to produce light with an efficiency of at least about 150 lumens per watt.

14. The method of claim 13 further comprising connecting an Edison base to the power supply.

15. The method of claim 14 wherein the portion of the primary exit surface is spaced at least about 3 inches from the LED assembly.

16. The method of claim 13 wherein the providing of the LED assembly further comprises packaging one of the first and second LEDs with a phosphor.

17. The method of claim 16 wherein the first and second LEDs, when illuminated, emit light having a dominant wavelength from 435 to 490 nm and a dominant wavelength from 600 to 640 nm, respectively, and the phosphor, when excited, emits light having a dominant wavelength from 540 to 585 nm.

18. The method of claim 17 wherein the first and second LEDs, when illuminated, emit light having a dominant wavelength from 440 to 480 nm, and a dominant wavelength from 605 to 630 nm, respectively and the phosphor, when excited, emits light having a dominant wavelength from 560 to 580 nm.

19. The method of claim 18 wherein the portion of the primary exit surface is spaced from about 1.5 to about 8 inches away from the LED assembly.

20. A lamp comprising:

an LED assembly to emit light; and a cylindrical optical enclosure including a curved surface and a primary exit surface for the light at an end so that a large percentage of the light strikes the curved surface at an oblique angle and exits through the primary exit surface, wherein at least a portion of the primary exit surface is spaced at least 1.5 inches from the LED assembly.

21. The lamp of claim 20 wherein the optical enclosure is one of a cylinder and a frustoconical shape.

22. The lamp of claim 21 operable to emit light with an efficiency of 150 lumens per watt and a total output of 1200 lumens.

23. The lamp of claim 22 wherein the light emitted has a color rendering index of at least 90 and a coordinated color temperature CCT of 2500 to 3500 K.

24. The lamp of claim 23 wherein the light emitted has a CCT of 2800 to 3000.

25. The lamp of claim 21 wherein the portion of the primary exit surface is at least 3 inches from the LED assembly.

26. The lamp of claim 21 wherein the portion of the primary exit surface is less than 8 inches from the LED assembly.

27. The lamp of claim 25 wherein the portion of the primary exit surface is less than 8 inches from the LED assembly.

* * * * *